US005785606A

United States Patent [19]

Marquez

[11] Patent Number: 5,785,606

[45] Date of Patent: Jul. 28, 1998

[54] METHOD OF PLAYING MULTIPLE HAND CARD GAME

[76] Inventor: Ruben L. Marquez, 5134 Pattijo Dr., Carmichael, Calif. 95608

[21] Appl. No.: 850,522

[22] Filed: May 2, 1997

[51] Int. Cl.[6] ..... A63F 1/00

[52] U.S. Cl. ..... 273/292

[58] Field of Search ..... 273/292, 274, 273/303

[56] References Cited

U.S. PATENT DOCUMENTS

| | | | |
|---|---|---|---|
| 5,154,429 | 10/1992 | Le Vasseur | 273/292 |
| 5,224,706 | 7/1993 | Bridgeman et al. | 273/292 X |
| 5,265,882 | 11/1993 | Malek | 273/292 |
| 5,288,082 | 2/1994 | Marquez | 273/292 |
| 5,294,128 | 3/1994 | Marquez | 273/292 |
| 5,314,193 | 5/1994 | Ferrer | 273/292 |
| 5,328,189 | 7/1994 | Malek | 273/292 |
| 5,366,228 | 11/1994 | Kangsanaraks | 273/292 |
| 5,395,120 | 3/1995 | Malek | 273/292 |
| 5,645,281 | 7/1997 | Hesse et al. | 273/292 |

*Primary Examiner*—William E. Stoll
*Attorney, Agent, or Firm*—John P. O'Banion

[57] ABSTRACT

A multiple hand variation of the card game Twenty-One involving individual players being dealt five cards, the five cards being divided into a two-card hand and a three-card back hand is disclosed. In a first embodiment of the invention, the cards are arranged into a two-card hand that comes as close to twenty-two points as possible, and into a three-card hand made up of the remaining cards. The two-card hand, which is the better of the two hands, is designated as the "front" hand and is positioned in front of the other hand, which is designated the "back" hand. In the event that the back hand exceeds twenty-two points, ten points are automatically subtracted from the back hand to prevent a "bust" from occurring with regard to that hand. In a second embodiment of the invention, the player has the option of maximizing either the two-card hand or the three-card hand to a predetermined point level. The better of the two hands is then designated as the "front" hand and is positioned in front of the other hand, which is designated the "back" hand. In both embodiments, the players competitively wager their front and back hands against the front and back hands of the bank.

6 Claims, No Drawings

METHOD OF PLAYING MULTIPLE HAND CARD GAME

BACKGROUND OF THE INVENTION

1. Field of the Invention

This invention pertains generally to a method of playing a card game, and more particularly to a method of playing a card game wherein multiple players simultaneously play a front hand and a back hand, one of which has one less card than the other, with the object of arranging the cards in both hands to come as close to a predetermined value possible, without exceeding that value, while at the same time maximizing the value of the front hand.

2. Description of the Background Art

Card games where a winning hand is based on the value of the hand coming as close to a predetermined value as possible, without exceeding that value, are well known. For example, the game of "Twenty-One" has been a staple in most casinos worldwide for a number of years. The objective of Twenty-One is to have a hand where the sum of the designated values of each card in the hand comes as close as possible to the number twenty-one, without exceeding it. The hand which equals, or achieves the sum closest to twenty-one, without going over, is designated the winning hand. Losing hands are deemed to be all hands having a lesser sum than the winning hand, and all hands which exceed the sum of twenty-one. It is also possible to have tying hands in the game of Twenty-One. The game has also been subjected to many variations, depending usually upon the customs or rules of the casino in which the game is played, or else upon the demand for a particular variation imposed by the players. Most of these variations involve modifications upon the conventional method of playing Twenty-One where the dealer's single hand competes against the player's single hand.

However, variations of the game of Twenty-One involving play with multiple hands, are also known. For example, in my earlier patent, U.S. Pat. No. U.S. 5,288,082, incorporated herein by reference in its entirety, I presented a method of playing a game called Double Hand Marquez. In Double Hand Marquez, players are permitted to simultaneously play a front hand and a back hand. The hands are arranged so that the front hand has one less card than the back hand, with the object of arranging the cards in both hands to come as close to twenty-one as possible, without exceeding twenty one, while at the same time maximizing the value of the front hand. In play, however, it was found that requiring the front hand to have one less card than the back hand, while also requiring the front hand to be a better hand than the back hand, was too complicated for many players. In addition, it was found that there were certain restrictions imposed upon public casinos and card rooms against playing card games where winning hands are based on achieving twenty-one points. It was also found that there was a general adversity to have a hand "bust" if it exceeds twenty-one points.

BRIEF SUMMARY OF THE INVENTION

Accordingly, in accordance with a first aspect of the invention five cards are arranged into a two-card hand that comes as close to twenty-two points as possible, and into a three-card hand made up of the remaining cards. The two-card hand, which is the better of the two hands, is designated as the "front" hand and is positioned in front of the other hand, which is designated the "back" hand. In the event that the back hand exceeds twenty-two points, ten points are automatically subtracted from the back hand to prevent a "bust" from occurring with regard to that hand.

In accordance with another aspect of the invention, the player divides his or her five cards into a two-card hand and a three-card hand. At the option of the player, however, either the two-card hand or the three-card hand is maximized so that its numerical sum equals a maximum point value (e.g., twenty-one) or comes as close to the maximum point value as possible. The better of the two hands is then designated as the "front" hand and is positioned in front of the other hand, which is designated the "back" hand.

The two hands are then played according to either standard or modified point counting and wagering rules of conventional Twenty-One, with the players competitively wagering their front and back hands against the front and back hands of the bank player, respectively.

An object of the invention is to provide a card game based on the point counting and wagering rules of Twenty-One wherein multiple hands having multiple bets can be played simultaneously.

Another object of the invention is to provide a card game based on the point counting and wagering rules of Twenty-One wherein two hands are divided into a hand having a greater number of cards and a hand having a lesser number of cards.

Another object of the invention is to provide a card game based on the point counting and wagering rules of Twenty-One wherein the cards in two hands are arranged so as to place the better of the two hands in front of the other hand.

Still another object of the invention is to provide a card game based on the point counting and wagering rules of Twenty-One wherein a bank player wagers multiple card hands against the multiple card hands played by a plurality of players.

Further objects and advantages of the invention will be brought out in the following portions of the specification, wherein the detailed description is for the purpose of fully disclosing preferred embodiments of the invention without placing limitations thereon.

DETAILED DESCRIPTION OF THE INVENTION

Accordingly, in accordance with an aspect of the invention referred to as Double Hand Marquez 22, five cards are dealt to each player as explained in my previous U.S. Pat. No. 5,288,082, which is incorporated herein by reference in its entirety. Next, each player divides his or her five cards into a two-card hand that comes as close to twenty-two points as possible, and into a three-card hand made up of the remaining cards. The two-card hand, which is the better of the two hands, is designated as the "front" hand and is positioned in front of the other hand, which is designated the "back" hand. In this regard, the two-card front hand must be maximized in relation to the three-card back hand so as to comprise the better of the player's two hands, even if the result is that the back hand exceeds twenty-two points. An exception to this rule is what is called a "reverse" hand. In those special circumstances where, regardless of how the five cards are arranged, the three-card hand will have a larger value than the two-card hand (without exceeding twenty-two), the three-card hand is placed in front. Also, in the event that the back hand does exceed twenty-two points, ten points are automatically subtracted from the back hand to prevent a "bust" from occurring with regard to that hand. Note also that a "Marquez" now would be when both of a player's hands have values of twenty-two.

In accordance with another aspect of the invention which is referred to as Double Hand Marquez II, five cards are dealt to each player as before. Next, each player divides his or her five cards into a two-card hand and a three-card hand. At the option of the player, however, either the two-card hand or the three-card hand is maximized so that its numerical sum equals a maximum point value (e.g., twenty-one) or comes as close to the maximum point value as possible. The better of the two hands is then designated as the "front" hand and is positioned in front of the other hand, which is designated the "back" hand. Note that, unlike the first version of the game described above or in my previous U.S. Pat. No. 5,288,082, there is no "reverse" hand in this version of the game.

The two hands are then played according to either standard or modified point counting and wagering rules of conventional Twenty-One, with the players competitively wagering their front and back hands against the front and back hands of the bank player, respectively. Such rules and other aspects of the games are set forth in my previous U.S. Pat. No. 5,288,082. It will be appreciated, however, that the method of playing the game of the present invention as described above may vary as to the particular steps and their sequence without departing from the basic concepts as disclosed herein.

Accordingly, it will be seen that this invention provides a card game based on the conventional game of Twenty-One where players competitively wager multiple hands simultaneously against the multiple hands of a bank player. The present invention, however, increases the number of hands in play compared to conventional Twenty-One, and likewise, increases the amount of wagering occurring at any one time. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A method of playing a card game, comprising the steps of:

(a) providing at least one deck of playing cards;

(b) establishing numerical values for each card in said deck;

(c) dealing a plurality of cards to a player and a bank player, said player and said bank player being dealt the same number of cards;

(d) said player and said bank player each arranging the cards dealt thereto, respectively, into a first hand and a second hand, said first hand containing one less card than said second hand, each said hand having a numerical sum;

(e) said player and said bank player each arranging the cards in their respective hands to produce at least one hand having a numerical sum that is closest to, without going over, twenty-two;

(f) said player and said bank player each designating as a front hand that player's hand having a numerical value closest to twenty-two without exceeding twenty-two than that player's remaining hand and further designating as a back hand that player's remaining hand;

(g) subtracting ten points from the numerical value of said back hand in the event that the numerical value of said back hand exceeds twenty-two;

(h) comparing the numerical sum of said player's front hand with the numerical sum of said bank player's front hand, with the highest numerical sum not exceeding twenty-two winning said front hand; and (i) comparing the numerical sum of said player's back hand with the numerical sum of said bank player's back hand, with the highest numerical sum not exceeding twenty-two winning said back hand.

2. The method as recited in claim 1, wherein five cards are dealt to said player and five cards are dealt to said bank player.

3. The method as recited in claim 1, wherein said cards in each said hand may optionally be arranged such that said second hand comprises a hand having a numerical value closer to twenty-two without exceeding twenty-two than said first hand.

4. A method of playing a game with at least one deck of playing cards, each said playing card in said deck having a numerical value, said method comprising the steps of:

(a) dealing a plurality of cards to a player;

(b) said player arranging said cards into a first hand and a second hand, said first hand containing one less card than said second hand;

(c) said player arranging said cards in at least one said hand to produce a hand having a numerical sum that is closest to, without going over, twenty-two;

(d) said player designating as a front hand the player's hand having a numerical value closest to twenty-two without exceeding twenty-two than the player's remaining hand and further designating the player's remaining hand as a back hand;

(e) subtracting ten points from the numerical value of said back hand in the event that the numerical value of said back hand exceeds twenty-two;

(f) repeating steps (a) through (e) for a bank player;

(g) comparing the numerical sum of said player's front hand with the numerical sum of said bank player's front hand, with the highest numerical sum not exceeding twenty-two winning said front hand; and (h) comparing the numerical sum of said player's back hand with the numerical sum of said bank player's back hand, with the highest numerical sum not exceeding twenty-two winning said back hand.

5. A method of playing a game with a plurality of playing cards, each said playing card having a numerical value, said method comprising the steps of:

(a) dealing a plurality of cards to a player;

(b) dealing a plurality of cards to a bank player;

(c) said player and said bank player being dealt the same number of cards;

(d) said player arranging said cards dealt to said player into a first hand and a second hand, said first hand containing one less card than said second hand, said player arranging said cards in at least one said hand to produce a hand having a numerical sum that is closest to, without going over, twenty-two, said player designating the player's hand having a numerical value closer to twenty-two without exceeding twenty-two than the player's remaining hand and further designating the player's remaining hand as a back hand, wherein ten points is subtracted from the numerical value of said back hand in the event that the numerical value of said back hand exceeds twenty-two;

(e) said bank player arranging said cards dealt to said bank player into a first hand and a second hand, said first hand containing one less card than said second hand, said bank player arranging said cards in at least one said hand to produce a hand having a numerical sum that is closest to, without going over, twenty-two, said bank player designating the bank player's hand having a numerical value closer to twenty-two without exceeding twenty-two than the bank player's remaining hand and further designating the bank player's remaining hand as a back hand, wherein ten points is subtracted from the numerical value of said back hand in the event that the numerical value of said back hand exceeds twenty-two;

(f) comparing the numerical sum of said player's front hand with the numerical sum of said bank player's front hand, with the highest numerical sum not exceeding twenty-two winning said front hand; and (g) comparing the numerical sum of said player's back hand with the numerical sum of said bank player's back hand, with the highest numerical sum not exceeding twenty-two winning said back hand.

6. The method as recited in claim 5, wherein five cards are dealt to said player and five cards are dealt to said bank player.

* * * * *